US005671912A

United States Patent [19]

Langford et al.

[11] Patent Number: 5,671,912

[45] Date of Patent: Sep. 30, 1997

[54] METHOD & APPARATUS FOR PROVIDING LOW SPEED SAFETY BRAKING FOR A HOIST SYSTEM

[75] Inventors: Fred E. Langford, Redmond; Roger A. Johnson, Mukilteo, both of Wash.

[73] Assignee: Ederer Corporation, Seattle, Wash.

[21] Appl. No.: 547,600

[22] Filed: Oct. 24, 1995

Related U.S. Application Data

[63] Continuation-in-part of Ser. No. 290,552, Aug. 10, 1994, abandoned.

[51] Int. Cl.[6] ..... B66D 5/26

[52] U.S. Cl. ..... 254/267; 188/77 R; 188/82.6; 254/379

[58] Field of Search ..... 254/267, 266, 254/378, 379; 188/77 R, 77 W, 170, 180, 82.6, 82.1, 82.2

[56] References Cited

U.S. PATENT DOCUMENTS

| | | | |
|---|---|---|---|
| 744,632 | 11/1903 | Sedgwick et al. | 188/82.6 |
| 2,383,276 | 8/1945 | Smith | 188/82.6 |
| 2,492,816 | 12/1949 | Rosman | 188/82.6 |
| 2,894,605 | 7/1959 | Leavitt | 188/82.6 |
| 3,550,735 | 12/1970 | Olsen . | |
| 3,572,482 | 3/1971 | Kalpas et al. . | |
| 3,819,156 | 6/1974 | Sieracki . | |
| 3,907,075 | 9/1975 | Christison et al. . | |
| 3,934,856 | 1/1976 | Shaw . | |
| 3,994,476 | 11/1976 | Gennep . | |
| 4,069,921 | 1/1978 | Raugulis et al. | 254/379 |
| 4,151,981 | 5/1979 | Gennep . | |
| 4,177,973 | 12/1979 | Miller et al. . | |
| 4,434,971 | 3/1984 | Cordrey | 254/379 |
| 4,493,479 | 1/1985 | Clark . | |
| 4,865,393 | 9/1989 | Falcon | 254/39 |
| 4,884,783 | 12/1989 | McIntosh et al. . | |
| 4,977,982 | 12/1990 | Bialy et al. | 188/180 |
| 5,425,435 | 6/1995 | Gregory | 254/379 |

*Primary Examiner*—Katherine Matecki

*Attorney, Agent, or Firm*—Christensen, O'Connor, Johnson & Kindness PLLC

[57] ABSTRACT

At predetermined low speeds, a safety brake is applied directly to the hoisting drum at a setting sufficiently high to stop the load from falling should drive line failure occur. The load can be lowered or raised by applying sufficient torque to the drum to overcome the braking force and thus lower or raise the load. If drive train failure occurs, the brake will instantaneously stop the load without further uncontrolled movement.

8 Claims, 1 Drawing Sheet

METHOD & APPARATUS FOR PROVIDING LOW SPEED SAFETY BRAKING FOR A HOIST SYSTEM

This application is a continuation-in-part application based on prior application Ser. No. 08/290,552, filed on Aug. 10, 1994.

FIELD OF THE INVENTION

The present invention relates to hoisting systems, and more particularly to hoisting systems that employ safety brake mechanisms to prevent the hoisted load from falling upon drive train failure, and most particularly to a safety braking system that allows a load to be moved and positioned at low speeds while retaining the capability to stop load movement immediately in the event of drive train failure.

BACKGROUND OF THE INVENTION

In conventional hoisting systems, a load is dynamically braked through the motor or a separate eddy current brake and held by a separate holding brake applied to the drive train near the motor. When additional braking is desired, another holding brake is added, again, at the drive train near the motor. In this type of system, a failure in the drive train can cause the load to drop uncontrollably, whether the load is being raised or lowered. For critical loads such as those encountered in the nuclear industry, or for very sensitive or easily damaged loads, such as payloads for booster rockets, uncontrolled motion of the load is unacceptable. Accordingly, a variety of safety systems have been developed to prevent uncontrolled load motion under most circumstances.

A first type of safety system employs a dual load path wherein redundant drive trains are employed to hoist and lower a load. In the event of failure of one of the drive trains, the redundant drive train continues to support the load. These redundant drive systems are satisfactory for some systems, but take up substantial room in the hoist system, are very expensive to implement, and failure of one drive allows a certain mount of load motion as the redundant drive picks up the load.

Another approach to controlling the load movement upon failure of the drive system is to locate an additional brake that acts directly on the drum on which the wire hoisting rope is wound. The control system for the brake is designed to sense uncontrolled load motion, such as overspeed of the drum, at which time the brake is applied. This system is satisfactory for many applications; however, where precise positioning of a load is required, for example, when positioning a load such as a space shuttle on a booster rocket, this system still allows a substantial amount of unacceptable movement after drive train failure due to the inherent response time for application of the drum brake.

SUMMARY OF THE INVENTION

The present invention therefore provides a system and method for preventing uncontrolled movement of a load being hoisted upon failure of the hoist drive system, especially when the drive train is traveling at low speeds, for example, when positioning a load at a critical location. The present invention therefore provides a method for preventing a load suspended from a hoist system from dropping uncontrollably in the event of drive train failure. The hoist system normally includes a drum and a wire rope wrapped about the drum, the rope being secured to the drum and coupled to a load. The load normally applies a force to the wire rope that tends to unwind the rope from the drum. A prime mover is operably coupled through a drive train to the drum for bidirectional rotation of the drum in both a winding and an unwinding direction. The prime mover is capable of providing sufficient torque in a winding direction to wind the wire rope onto the drum when the load is coupled thereto. A primary brake is associated with the drive train and is capable of selectively stopping rotation of the drive train to hold the load at a predetermined position. A secondary brake is coupled to the drum and is capable of applying a brake force to the drum that will counteract the unwinding force exerted on the drum by the load and stop the load. The secondary brake can be applied to the drum with sufficient force to stop the unwinding of the rope when a maximum load is coupled thereto. The secondary brake is applied only when lowering or raising the load at or below a predetermined speed. When the brake is applied, sufficient torque is applied to the drum by the prime mover in the unwinding direction to overcome the resistance of the secondary brake and lower the load. Thus, while lowering a load at predetermined low speeds, the secondary brake is always applied and is capable of stopping the load immediately in the event of drive train failure. At higher speeds above the predetermined speed, the secondary brake is released, thus eliminating excessive energy use and wear on the system.

In another aspect of the invention, a hoist system is provided that comprises a drum and a wire rope wrapped about the drum. The rope is secured to the drum and coupled to a load. The load applies a force to the wire rope tending to unwind the rope from the drum. The hoist system further comprises a prime mover operably coupled through a drive train for bidirectional rotation of the drum in both a winding and an unwinding direction. The prime mover is capable of providing sufficient torque in a winding direction to wind the wire rope onto the rope drum when a load is coupled thereto. A primary brake is also provided that is associated with the drive train and is capable of selectively stopping rotation of the drive train to hold the load at a predetermined position. The hoist system also includes a secondary brake coupled directly to the drum that is capable of applying a braking force to the drum that will counter the unwinding force exerted on the drum by the load and stop the load. The secondary brake is applied with sufficient braking force to stop the unwinding of the rope when no unwinding torque is being supplied to the prime mover. The secondary brake is applied only at and below a predetermined low raising or lowering speed. The prime mover is capable of supplying unwinding torque to the drum in an unwinding direction at and below said predetermined low unwinding speed to overcome the braking force of the secondary brake and thereby slowly unwind the rope and lower the load. The secondary brake is therefore always capable of stopping the unwinding of the rope in the event of drive train failure.

BRIEF DESCRIPTION OF THE DRAWINGS

A better understanding of the invention can be derived by reading the ensuing specification in conjunction with the accompanying drawings wherein.

DETAILED DESCRIPTION OF THE PREFERRED EMBODIMENT

Figure 1:
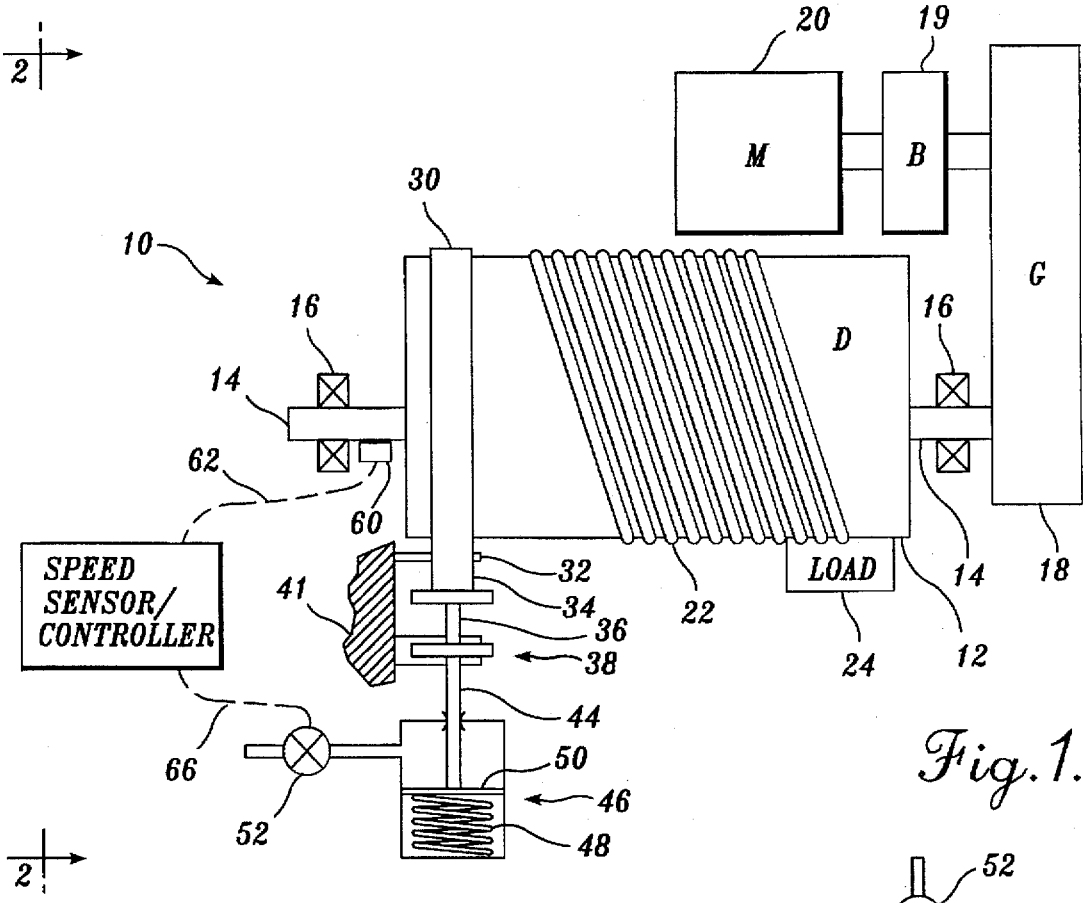
FIG. 1 is a schematic plan view of a hoist system employing the safety braking mechanism in accordance with the present invention.
Figure 2:
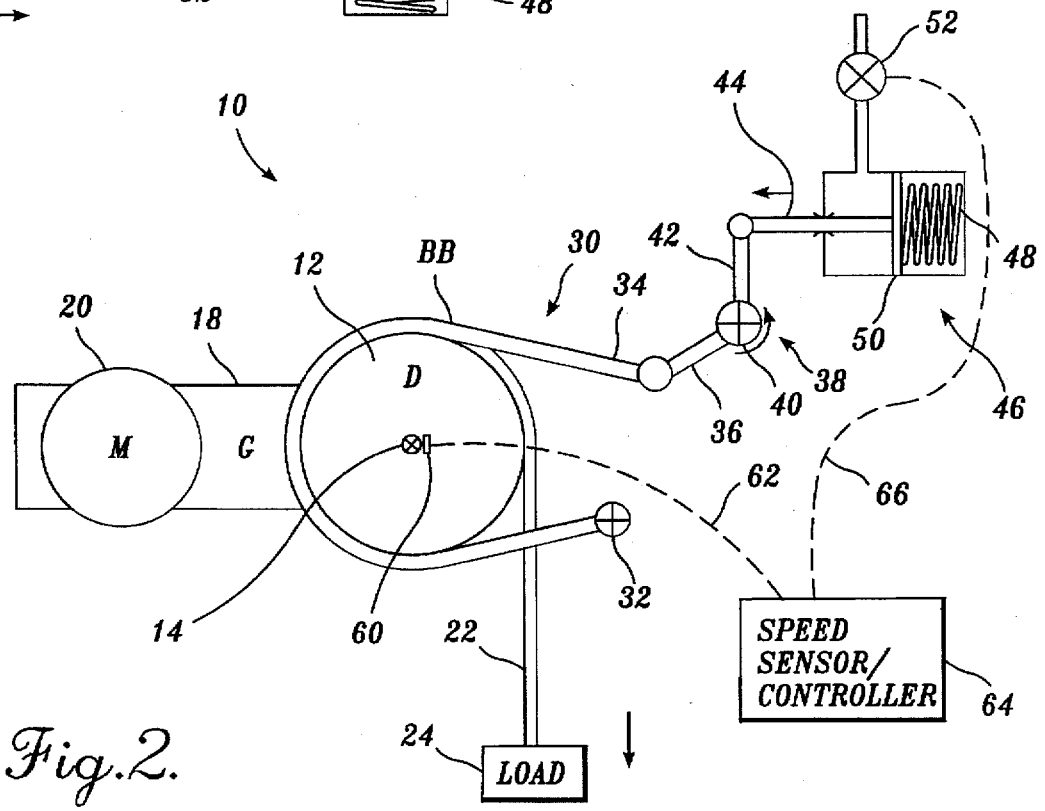
FIG. 2 is a side elevation view of FIG. 1.

Referring conjunctively to FIGS. 1 and 2, a hoist system, generally designated 10, includes a drum 12 mounted on a shaft 14 in turn mounted on bearing sets 16. Shaft 14 is coupled at its one end to the output side of a gear box 18. A motor 20 is coupled to the input side of a gear box 18. The motor is capable of bidirectionally driving the shaft 14 and thus the drum 12 through the drive train in both a clockwise and a counterclockwise direction, as viewed in FIG. 2. The motor 20 can also function in a conventional manner to dynamically brake the drive train when, for example, a load is applied to the drum 12. A drive train brake 19 is positioned for engagement with the drive shaft of the motor 20 and the gear box 18. The drive train brake 19 can be selectively applied to stop the drive train and thus stop rotation of the drum 20, either at rest or to bring the drive train to rest on failure, for example, of the dynamic braking capability of the motor. The control systems for the motor and the drive train brake 19 are not shown or described, but would be any of a variety available in the prior art and certainly within the purview of one of ordinary skill in hoist design technology.

A wire rope 22 is wound about the drum 12 and at its free end supports a load 24. When the drum is rotated in a clockwise direction (as viewed in FIG. 2), the load is lowered; and when the drum is rotated in a counterclockwise direction, the load is lifted. It is, of course, understood by one of ordinary skill that a variety of mechanisms for coupling the wire rope 22 to the drum 12 and to the load 24 can be employed. For example, a number of systems including force-multiplying blocks can be employed. Additionally, the free end of the wire rope 22 need not be coupled directly to the drum, but can be coupled to other structure associated with the drum.

In the preferred embodiment depicted in FIGS. 1 and 2, a secondary band brake generally designated 30 is operably coupled to directly act on the drum 12. One end of the band brake 30 is anchored to a pin 32 or other structure in turn anchored to structure 41 forming part of the hoist system. In this embodiment, the band brake is wrapped about the drum from pin 32 in a clockwise direction, as viewed in FIG. 2. The other end of the brake 34 is coupled to one arm 36 of a crank, generally designated 38. The crank 38 is mounted on a pivot pin 40 in turn coupled to structure 41 associated with the hoist. The other arm 42 of the crank 38 is coupled to the piston rod 44 of a pneumatic actuator, generally designated 46.

The pneumatic actuator 46 is of conventional design and includes a coil spring 48 in compression that normally biases the internal piston 50 of the actuator so as to move the crank in a counterclockwise direction. This crank motion in turn pulls the free end 34 of the band brake 30 away from the drum, causing it to tightly wrap about and be applied to the drum 12. Spring 48 and the mechanical advantage provided by crank 38 apply sufficient braking force to the band brake 30 to stop and prevent movement of the load 24 as it exerts an unwinding force on the wire rope 22. Air pressure can be applied to the front side of the piston 50 through air pressure valve 52. Sufficient air pressure can be applied so that the force of spring 48 is overcome, moving piston 50 away from the crank arm and rotating it in a clockwise direction, thus releasing the band brake from the drum 12.

A speed sensor 60 is associated with the shaft 14 and can sense the rotational speed of the shaft 14 and thus the rotational speed of the drum 12. The output of the speed sensor 60 is delivered via output line 62 to a speed sensor/controller 64. In a preferred embodiment, the speed sensor/controller sends a signal via signal line 66 to the pneumatic control valve 52 to decrease the pressure ahead of pneumatic cylinder piston 50 so as to apply the band brake 30 when the sensed speed of the drum reaches a predetermined minimum. Of course, the speed sensor/controller can be manually overridden if desired by the hoist operator.

In operation the band brake 30 is applied at and below a predetermined low speed of the drum 12. If no torque is applied to the drum through motor 20 and gear box 18, the band brake will apply a force sufficient to counteract the weight of the load 24, and thus the load will be retained at its fixed position. If torque is applied via the motor and gear box to the drum in a clockwise direction, only torque sufficient to overcome the band brake is required to lower the load. Normally the band brake is designed and applied so that it is set at about 125% of the load. Thus, the motor torque required to overcome the band brake setting in an unwinding direction is about 25% of the load, a small amount compared to the normal capability of the motor. Thus, sufficient torque can be applied by the motor to slowly lower the load at any desired low speed, whether at a rate of, for example, 1 inch per minute or 10 inches per minute. Because the amount of heat generated by driving the load downwardly through the brake is relatively small at low speeds, very little if any additional cooling capability needs to be supplied to the band brake and the drum. If a drive train failure should occur, for example, in the shaft 14, gear box 18, primary brake 19, motor 20, or the hoist control system, the band brake will remain applied and will prevent any uncontrolled lowering of the load and its associated load motion. The safety braking system of the present invention thus functions continuously when the load is being raised or lowered at a speed at or below the predetermined minimum.

When it is desired to lift the load, torque is applied via the motor and gear box to rotate the drum 12 in a counterclockwise direction. The band brake in its preferred embodiment is at least partially self-releasing when the drum is rotated in a counterclockwise direction. Normally, the brake will release up to about 70% of its hauling capability. Thus, the torque required by the motor to raise the load is on the order of 130% of the load. At low speeds, this is well within the capability of the ordinary design of a hoist system. Again, if the drive train should fail during lifting of the load at low speeds, the band brake remains applied and will resist downward load movement at its predetermined setting, thus retaining the load at the precise position it was when the drive train failure occurred.

The present invention has been described in conjunction with the preferred embodiment. One of ordinary skill will readily understand that various alterations, changes, and substitutions of equivalents can be made without departing from the broad concepts disclosed herein. For example, the preferred embodiment employs a band brake. Any of a variety of other brakes including drum brakes, disc brakes, and so on, can be employed with equal efficacy. It is therefore intended that the Letters Patent granted hereon be limited only by the definitions made in the appended claims and claims and equivalents thereof.

The embodiments of the invention in which an exclusive property or privilege is claimed are defined as follows:

1. A hoist system comprising:

a drum, a wire rope wrapped about said drum, said rope being secured to said drum and being connected to a load, the load applying a force to the wire rope tending to unwind the rope from the drum, a prime mover and a drive train coupling said prime mover to said drum for bidirectional rotation of said drum in a winding and an unwinding direction, said prime mover being capable of providing sufficient torque in a winding direction to wind wire rope onto said drum when a load is connected to said rope, a primary brake associated with the drive train and being capable of selectively stopping rotation of the drive train to hold the load at a predetermined position, a secondary brake coupled directly to said drum and being capable of applying a braking force to said drum that will counter the unwinding force exerted on said drum by said load to stop the load, a sensor for sensing the rotational speed of the drum, and a brake control for applying said secondary brake with sufficient braking force to stop the unwinding of said rope when no unwinding torque is being supplied by said prime mover, said brake control applying said secondary brake only at and below a predetermined speed of said drum, said prime mover being capable of supplying sufficient unwinding torque to said drum in an unwinding direction at and below said predetermined speed to overcome the braking force of said secondary brake and thereby unwind said rope and lower said load, said secondary brake being capable of stopping the unwinding of said rope in the event of drive train failure.

2. The hoist system of claim 1 wherein said secondary brake is is capable of at least partially self-releasing when said drum is rotated in the winding direction thereby applying only a fractional braking force when said drum is rotated in the winding direction, said prime mover being capable of supplying sufficient torque in the winding direction to wind rope onto the drum when a load is coupled thereto and simultaneously to overcome said fractional braking force, said secondary brake being capable of automatically resetting said sufficient braking force to stop the unwinding of said drum the event of drive train failure during winding.

3. The hoist system of claim 2 wherein said secondary brake is a band brake.

4. The hoist system of claim 1 further comprising:

a control responsive to the output of said sensor for applying said secondary brake when the speed of said drum decreases to a predetermined minimum.

5. A method for preventing a load suspended from a hoist system from dropping uncontrollably in the event of drive train failure, the hoist system including a drum, a wire rope wrapped about said drum, said rope being secured to said drum and being connected to a load, the load applying a force to the wire rope the drum, a prime mover and a drive train coupling said prime mover to said drum for bidirectional rotation of said drum in a winding and an unwinding direction, a primary brake associated with the drive train and being capable of selectively stopping rotation of the drive train to hold the load at a predetermined position, said prime mover being capable of providing sufficient torque in a winding direction to wind wire rope onto said drum when a load is coupled thereto, and a secondary brake coupled to said drum and being capable of applying a braking force to said drum that will counteract the unwinding force exerted on said drum by said load to stop the load, comprising the steps of:

applying the secondary brake to the drum with sufficient force to stop the unwinding of the rope when a load is coupled thereto only at and below a predetermined speed, and when lowering the load as said secondary brake is applied, applying sufficient torque to said drum from said prime mover in the unwinding direction to overcome the resistance of said secondary brake and thus slowly lowering the load, said secondary brake stopping the load immediately upon drive train failure.

6. The method of claim 5 further comprising: when raising the load at or below the predetermined speed, partially releasing said secondary brake as the drum is rotated in the unwinding direction, and resetting said secondary brake with said sufficient force in the event of drive train failure to prevent said load from dropping, and applying sufficient torque from the prime mover to the drum to raise the load and overcome the remaining resistance of the partially released secondary brake.

7. The method of claim 5 further comprising:

sensing the rotational speed of the drum, and applying said secondary brake when said rotational speed is at or below a predetermined minimum, and thereafter applying sufficient torque to said drum through said drive train to raise or lower said load over the resistance of said secondary brake.

8. The method of claim 5 wherein said secondary brake comprises a self-releasing and resetting band brake.

* * * * *

UNITED STATES PATENT AND TRADEMARK OFFICE

CERTIFICATE OF CORRECTION

PATENT NO. : 5,671,912

DATED : September 30, 1997

INVENTOR(S) : F.E. Langford et al.

It is certified that error appears in the above-identified patent and that said Letters Patent is hereby corrected as shown below:

| COLUMN | LINE | |
|---|---|---|
| 6 (Claim 5, | 2 line 6) | After "wire rope" insert --tending to unwind the rope from-- |
| 6 (Claim 6, | 25 line 1) | After "comprising:" begin new subparagraph with "when raising . . ." |

Signed and Sealed this

Seventeenth Day of February, 1998

*Attest:*

*Attesting Officer*

Bruce Lehman

BRUCE LEHMAN

*Commissioner of Patents and Trademarks*